US005651317A

United States Patent [19]

Kim

[11] Patent Number: 5,651,317

[45] Date of Patent: Jul. 29, 1997

[54] RAILROAD TIE EXCHANGER ATTACHMENT

[75] Inventor: John C. Kim, Darien, Ill.

[73] Assignee: Swingmaster Corporation, Franklin Park, Ill.

[21] Appl. No.: 718,024

[22] Filed: Sep. 23, 1996

Related U.S. Application Data

[63] Continuation of Ser. No. 433,169, May 3, 1995, abandoned.

[51] Int. Cl.[6] ..... E01B 29/00

[52] U.S. Cl. ..... 104/9

[58] Field of Search ..... 104/2, 6, 5, 7.1, 104/7.2, 8, 9

[56] References Cited

U.S. PATENT DOCUMENTS

| | | | |
|---|---|---|---|
| 3,675,580 | 7/1972 | Kershaw | 104/9 |
| 4,464,995 | 8/1984 | Nameny | 104/9 |
| 4,579,060 | 4/1986 | Nameny et al. | 104/9 |
| 4,770,103 | 9/1988 | Allmer | 104/9 |
| 4,951,573 | 8/1990 | Madison | 104/9 |
| 5,063,856 | 11/1991 | Theurer et al. | 104/9 |
| 5,197,389 | 3/1993 | Glomski et al. | 104/9 |
| 5,305,692 | 4/1994 | Madison et al. | 104/9 |

FOREIGN PATENT DOCUMENTS

| | | | |
|---|---|---|---|
| 2010077 | 3/1994 | Russian Federation | 104/9 |

*Primary Examiner*—Mark T. Le
*Attorney, Agent, or Firm*—Edward D. Gilhooly, Ltd.

[57] ABSTRACT

A tie exchange attachment for removing and installing track and switch ties having a clamp for gripping the ties for removal and insertion. Rail clamps are used to lift rails during removal and installation. A kicker is used to break the tie loose. The rail clamp is adjustable to adapt to track and switch ties.

11 Claims, 3 Drawing Sheets

RAILROAD TIE EXCHANGER ATTACHMENT

This is a continuation of application Ser. No. 08/433,169, filed May 3, 1995, now abandoned.

BACKGROUND OF THE INVENTION

1. Field of the Invention

This invention relates in general to rail tie handling equipment and, more particularly, to an improved railroad tie exchanger attachment.

2. Summary of the Prior Art

It is well known that railroad track comprises sections of steel rail laid along lateral ties constructed of wood and, in some instances, concrete. Individual ties may support two rails or multiple rails, such as at switch junctions and the like.

Through deterioration or accidents, it is necessary from time to time to replace damaged ties with new ones. In the past, old ties have been replaced by work crews. The manual replacement of ties is a relatively slow and inefficient process which is not cost effective. Equipment has been previously designed to mechanize the removal and reapplication of new ties beneath the rails. Such machinery is complex and expensive to operate and has not been effective in use. None of the prior equipment have provided an attachment that can be easily affixed to existing vehicles for convenient and rapid use. It is therefore desirable in the rail industry to provide an improved and efficient tie exchanger.

SUMMARY OF THE INVENTION

It is an objective of the present invention to provide an attachment to the boom of a wheeled vehicle for removing and inserting ties of rails. The invention herein disclosed is capable of exchanging ties which support two rails or three or more rails, such as at switching junctions. The attachment herein includes the ability to adjust to varying spacing between rails and clamp the rails for lifting. As the rail is lifted, jaws of the invention grip the tie beneath the rails and pulls it away. A kicker also is provided to break a tie loose and aid in its initial removal. After the tie is removed, the jaws engage a new tie while the rails are raised and insert the new tie. All of the foregoing operations can be performed by one workman manipulating the controls of the invention. The hydraulic circuit of the invention is connected to the auxiliary hydraulic circuit of vehicle upon which the attachment is mounted. The attachment is capable of exerting the large forces needed to perform its various operations. In one embodiment of the invention, for example, the tie exchanger attachment is capable of exerting a tie pull out force of approximately 20,000 pounds, a tie pushing force of 15,000 pounds, a tie holding force of 14,000 pounds with an extension stroke of 55½ inches.

DESCRIPTION OF A PREFERRED EMBODIMENT

Figure 1:
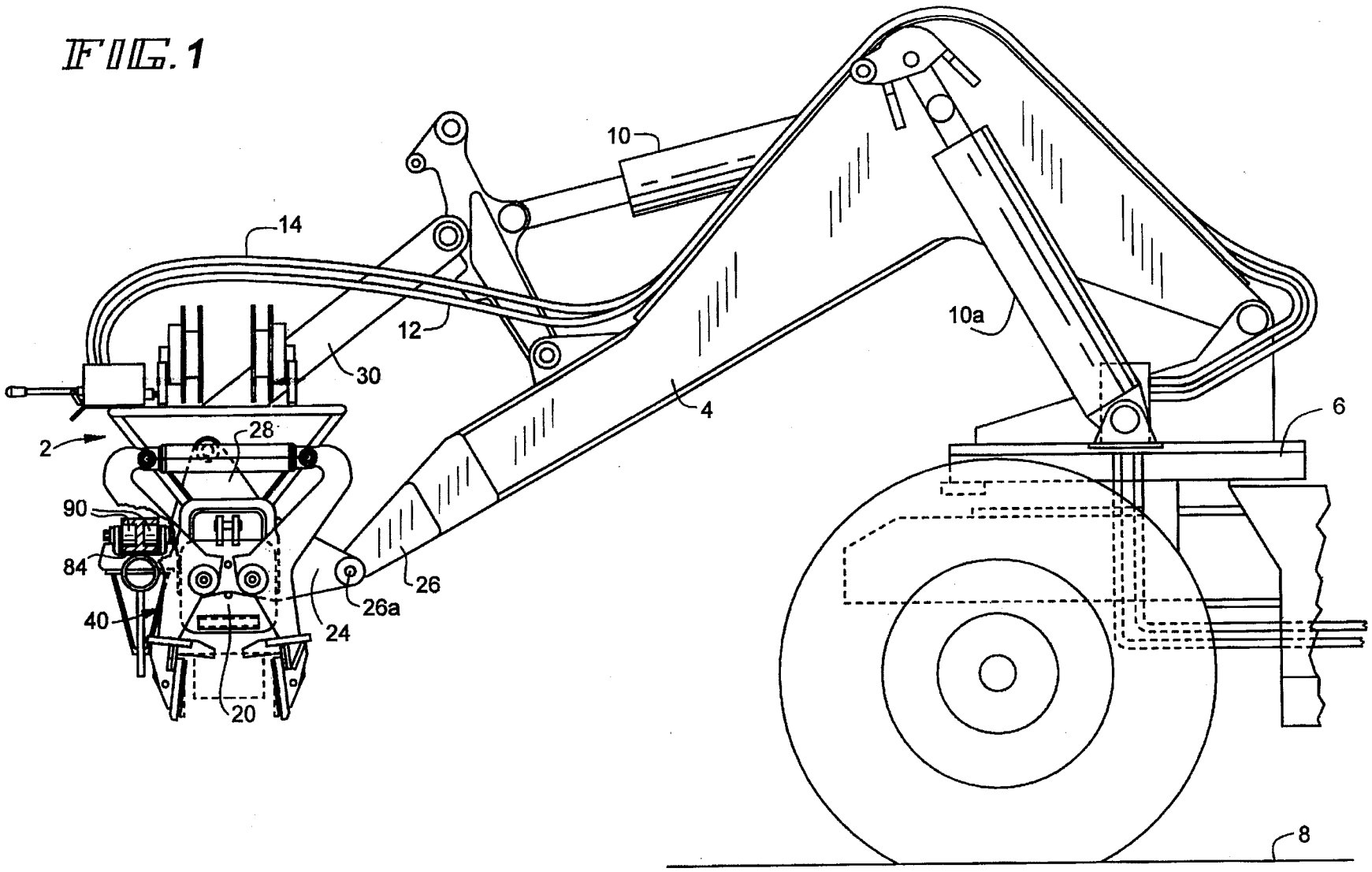
FIG. 1 is a side elevational partial view of the tie exchanger attachment of the invention on the boom of a vehicle.
Figure 2:
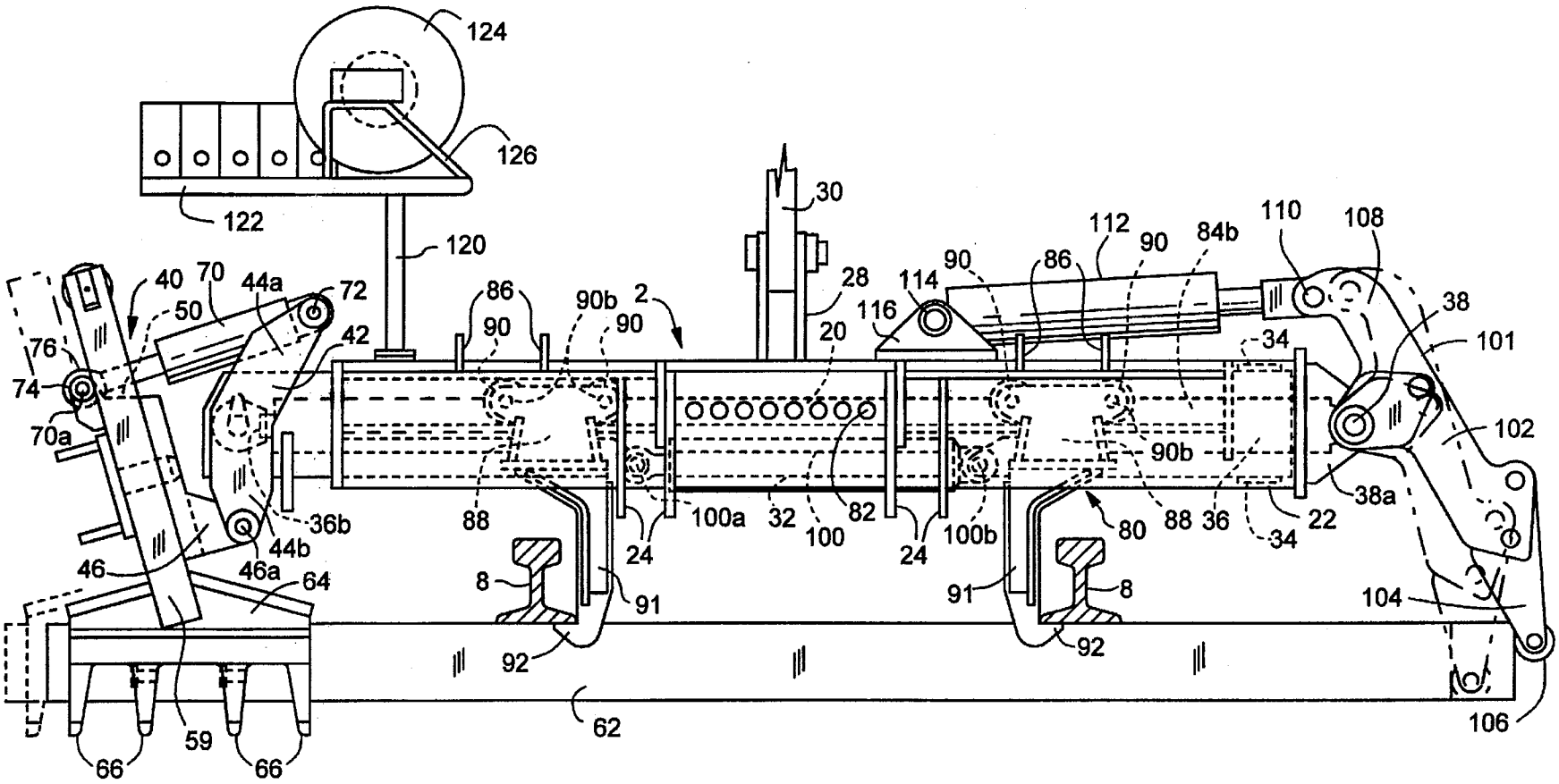
FIG. 2 is a back elevational view of the tie exchanger attachment of FIG. 1.
Figure 3:
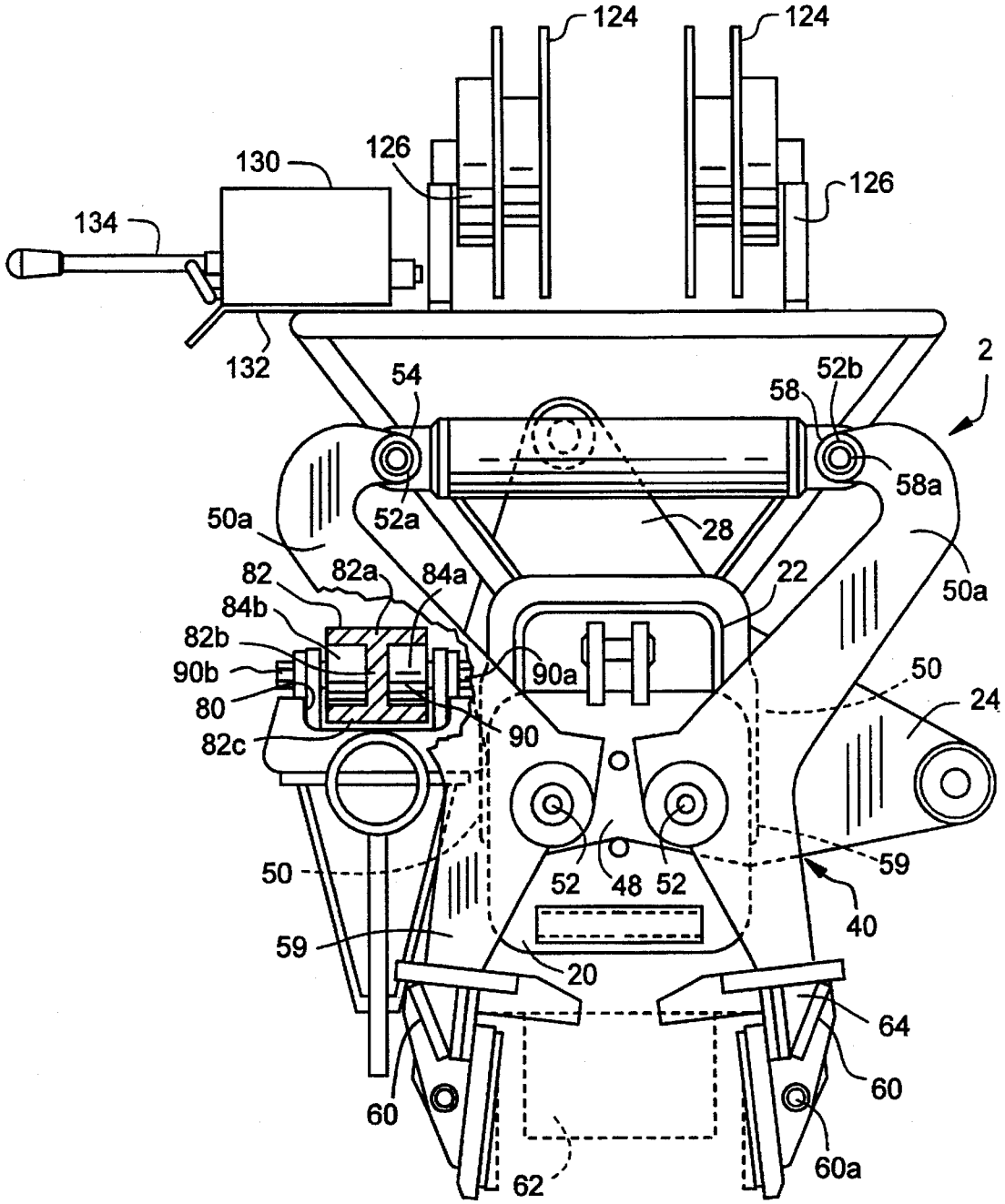
FIG. 3 is an end elevational view, with parts in section and parts removed, of the tie exchanger attachment of FIG. 2.

Referring to FIGS. 1–3, there is illustrated the tie exchanger attachment of the invention, generally designated by reference numeral 2. In FIG. 1 the tie exchange attachment 2 is mounted on the pivotally mounted boom 4 of a vehicle 6 which is capable of moving along rails 8. Although the tie exchanger attachment 2 is adaptable of being mounted on numerous types of equipment, one example of a commercially available vehicle on which attachment 2 may be mounted is sold as a Model 181 by Swingmaster Corporation of Franklin Park, Ill. As is conventional, the boom 4 is raised or lowered by the vehicle operator through control of hydraulic cylinder 10*a*. The vehicle 6 further includes an auxiliary hydraulic circuit (not shown) which delivers external hydraulic pressure through delivery line 12 and return line 14. The vehicle 6 is moveable along the rails 8 as the replacement of ties progresses.

As seen in FIGS. 1–3 the tie exchanger attachment 2 includes a housing 20 having an outer tube 22 arranged to be disposed above the ties in approximate parallel relationship. A pair of spaced bracket members 24 are affixed to the back of the outer tube 22 for pivotal attachment to the end 26 of boom 4 in a conventional connection using a pin 26*a*. In addition, a pair of triangular plates 28 are affixed to the top of housing 20 and are pivotally connected to the pivotal upper link 30 of vehicle 6.

The housing 20 further is provided with an internal extension tube 32 which is suitably mounted in moveable, telescopic relationship within outer tubular member 22. The outer tube 22 and internal extension tube 32 are maintained in spaced relationship for relative movement by low friction wear pads 34 mounted on the four external surfaces of tube 32 for movement in wiping action within outer tube 22 at least at both ends of housing 20 as shown in FIG. 2. A hydraulic cylinder 36 is suitably mounted within the internal extension tube 32 and has a fixed end 36*a* and an extendible end 36*b*. The fixed end 36*a* of the hydraulic cylinder 36 is affixed to a pin 38 extending through a pair of spaced weldments 38*a* welded to the end of outer tube 22. The extendible end 36*b* of hydraulic cylinder 36 is affixed to a pin 39 which extends through inner extension tube 32 and causes the inner extension tube 32 to telescopically move out of outer tube 22 upon extension of hydraulic cylinder 36. A tie clamping assembly 40 is pivotally attached to the extendible end 36*b* of hydraulic cylinder 36 by an arm 42. The arm 42 is welded to the extendible end 36*b* and includes an upper section 44*a* and a lower section 44*b*. Brackets 46 are pivotally affixed by pin 46*a* to the lower section 44*b* of arm 42 and supports a tie head weldment 48.

A pair of fork arms 50 are journaled to tie head weldment 48 by pins 52 to provide respective pivotal movement about pins 52. As seen in FIGS. 1 and 3, each fork arm 50 projects angular outward from housing 20 at upper portions 50*a*, and have inwardly disposed upper ends 52*a*, 52*b*. The fixed end 54 of a hydraulic cylinder 56 is pivotally affixed by a pin 54 to upper end 52*a* while the extendible end 58 of hydraulic cylinder 56 is pivotally affixed by a pin 58*a* to the opposite upper end 54*b*. The lower ends 59 of fork arms 50 support a jaw weldment 60 pivotally mounted by pin 60*a* thereto to engage and clamp the side of a tie 62 for removal, lifting or insertion. Each jaw weldment 60 includes an upper portion 64 from which a plurality of spaced projecting jaws 66 having gripping surfaces 66*a* extend downward from fork arms 50 for gripping the tie 62. By causing the extendible end 58 of hydraulic cylinder 56 to extend, it should be apparent that a clamping force can be applied by jaws 66 to a tie 62 through rotation of the fork arms 50 about pins 52.

A hydraulic cylinder 70 is pivotally attached at its fixed end 72 to the top portion of the upper section 44*a* of arm 44. The extendible end 74 of hydraulic cylinder 70 is pivotally affixed by a pin 70*a* to a bracket assembly 76 welded to tie head weldment 48. The hydraulic cylinder 70 allows the clamp weldment 60 to be rotated about pin 70*a* for better manipulation and for varying the orientation of the jaws 66, such as to angularly orient the end of a tie 62 for easier insertion under the rail under certain conditions.

A rail lifting assembly 80 is suitably mounted to the front side of housing 22 and includes a brace 81 for supporting an elongated H-beam 82. The H-beam 82 has an upper horizontal portion 82*a*, an intermediate vertical portion 82*b* and lower horizontal portion 82*c*. The H-beam 82 extends substantially the length of housing 22 and forms opposite tracks 84*a* and 84*b*. Support of H-beam 82 is reinforced by a plurality of upper brace plates 86. A pair of yoke-like supports 88 are respectively mounted for movement along tracks 84*a* and 84*b* on two opposed pairs of steel rollers 90. The rollers 90 are rotatably mounted on shafts 90*a* and 90*b* which extend through upper portions 94*a* and 94*b* of supports 88. A rail lifting weldment 91 extends downward from each of the supports 88 and forms rail clamping ends 92 for being positioned beneath two rails and lifting a rail upward to exchange a tie. The rail clamping ends 92 are each capable of being manually moved along the H-beam 82 to quickly adjust for the width between rails, whether a close spacing at switch junctions and the like, or a normal two rail track spacing.

A hydraulic cylinder 100 is affixed between the supports 88 with its fixed base 100*b* being attached to one of supports 88 and its extendible end 100*a* to the other. The hydraulic cylinder 100 is used for spacing adjustment and for clamping the rail clamping ends 92 beneath the rails.

Referring to FIG. 2, a kicker assembly 100 is shown having an arm 102 mounted for pivotal movement on fixed weldments 38*a* by pin 38. A kicker extension end 104 is welded to the lower portion of arm 102 and includes a roller 106 for contacting the ground. The upper portion 108 of arm 102 extends vertically above housing 20 and is connected to the extendible end 110 of a hydraulic cylinder 112. The base 114 of hydraulic cylinder 112 is affixed to the top of tube 22 by a pair of spaced welded brackets 116. The hydraulic cylinder 112 rotates arm 102 into contact with the end of a tie 62 to create a pushing force to aid in removal, such as to break a tie loose as needed in the field.

As seen in FIGS. 1–3 a tubular brace 120 is welded to housing 20 and forms horizontal supports 122. A pair of conventional hose reels 124 are rotatably mounted on supports 126. The hose reels 124 carry the hydraulic lines (not shown) that are connected to hydraulic cylinders 56 and 70 of the tie clamping assembly. The reels 124 allow the hydraulic lines to unreel as the internal extension tube 32 extends outward or is withdrawn. A control box 130 is suitably mounted on a plate 132 supported on brace 120. The control box 130 is coupled to the delivery line 12 and return line 14 (FIG. 3) of the auxiliary hydraulic circuit of vehicle 6. The control box 130 includes five control levers 134 connected to the hydraulic circuit (not shown) of attachment 2 respectively to control operation of housing hydraulic cylinder 36, hydraulic cylinders 56 and 70 for operating the tie jaws, hydraulic cylinder 100 of the rail clamps and kicker hydraulic cylinder 112.

In operation, the mounted attachment 2 is conveyed by vehicle 6 to a position where a tie 62 is to be exchanged. The rail clamps 92 are adjustably moved to engage two separated rails. The hydraulic cylinder 100 biases the rail clamps 92 outward beneath a pair of rails and the boom 4 of vehicle 6 lifts the two rails. The jaws 66 are then tightened into clamping relationship with a tie 62 and the internal extension tube 32 is caused by cylinder 36 to pull a tie outward from beneath the rails. Inasmuch as a typical tie is longer than the maximum extension of tube 32, the jaws 66 are released and the extension tube 32 can be retracted. The tie then is clamped at a new position and the internal tube is again extended to further remove the tie from beneath the rails. The foregoing procedure can be repeated until the tie is removed. Activation of the kicker hydraulic cylinder 112 at the outset of removal of the tie aids in its initial removal, particularly to break a tie loose. After the old tie is removed, a new tie is inserted under the rail with the extension tube 32 being retracted in a series of steps until the tie is fully in position. As an aid to insertion, the fork arms 50 are pivoted about pin 70*a* by cylinder 70 to initially orient the tie in a downward orientation for easier insertion beneath the lifted rail.

What is claimed is:

1. An apparatus capable of being attached to a boom of a vehicle for exchanging an existing rail tie with a replacement tie comprising housing means arranged to be attached to the boom of a vehicle, rail lifting means lifting a plurality of rails disposed over the existing rail tie being exchanged, said housing means having extendible means for pulling the existing railroad tie from beneath the plurality of rails, said extendible means having jaw means for selectively engaging the existing rail tie for removal along an axis away from the rail, while said rail lifting means is lifting the plurality of rails, said extendible means further inserts the replacement tie under the plurality of rails after removal of the existing rail tie, said extendible means includes an extendible tube mounted in telescopic relationship for movement on said housing means, a hydraulic power means coupled to said internal tube to cause said movement of said tube along an axis, said jaw means being pivotal about a pair of pivot axes parallel to said axis, said jaw being pivotal for gripping and releasing the existing tie and the replacement tie, said jaw means being pivotal about a transverse pivot axis for varying the horizontal orientation of a tie being engaged, a pair of spaced arms pivotally affixed to said extendible tube about said pair of pivot axes, said jaw means being mounted on said pair of arms, said pair of arms being pivotal about said transverse axis, second hydraulic means affixed to said extendible tube and said pair of arms to cause said movement about said transverse axis, and a hydraulic cylinder connected between said pair of arms for pivoting said pair of arms respectively about said pair of pivot axes.

2. The apparatus according to claim 1 wherein said hydraulic power means selectively causes movement of said extendible tube in opposite directions for removing the existing tie and inserting the replacement tie.

3. The apparatus according to claim 2 further comprising a kicker arm means pivotally mounted on said housing means, hydraulic power means operatively connected to said kicker arm means for causing said kicker arm means to engage a portion of the existing tie for pushing the tie from beneath the rail.

4. The apparatus according to claim 2 wherein said extendible tube is mounted for movement within an outer tube, said hydraulic power means being a hydraulic cylinder having an extendible end affixed to said extendible tube.

5. The apparatus according to claim 1 wherein said pair of spaced arms includes a pair of forks respectively mounted about said pair of pivotal axes, said forks having jaw surfaces at a lower end.

6. An apparatus capable of being attached to the boom of a vehicle for exchanging an existing rail tie with a replacement tie comprising housing means arranged to be attached to the boom of a vehicle, rail lifting means lifting a plurality of rails disposed over the existing rail tie being exchanged, said housing means having extendible means for pulling the existing railroad tie from beneath the plurality of rails, said extendible means having jaw means for selectively engaging the existing rail tie for removal while said rail lifting means is lifting the plurality of rails, said rail lifting means includes a pair of spaced supports and respective rail engaging clamps depending downward, adjustment means for varying the distance between said rail engaging clamps to adjust for variations in spacing between the rails being lifted, said adjustment means comprises an elongated support, said rail engaging clamps being moveable along said elongated support, and said pair of supports are mounted on tracks for free movement relative to said elongated support along a common axis generally transverse of said rails being lifted, said free movement permitting said pair of spaced supports to be linearly moved relative to each other to vary the distance between said pair of spaced supports to adjust for variations spacing between the rails.

7. An apparatus capable of being attached to the boom of a vehicle for exchanging an existing rail tie with a replacement tie comprising housing means arranged to be attached to the boom of a vehicle, rail lifting means lifting a plurality of rails disposed over the existing rail tie being exchanged, said housing means having extendible means for pulling the existing railroad tie from beneath the plurality of rails, said extendible means having jaw means for selectively engaging the existing rail tie for removal while said rail lifting means is lifting the plurality of rails, said rail lifting means includes a pair of supports and respective rail engaging clamps depending downward, adjustment means for varying the distance between said rail engaging clamps to adjust for variations in spacing between the rails being lifted, said adjustment means comprises an elongated support, said rail engaging clamps being moveable along said support, said pair of supports are mounted for movement along said elongated support, and said pair of supports are mounted on a plurality of rollers.

8. An attachment for a vehicle having a boom to exchange railroad ties comprising housing means having an extendible end being mounted for movement on said housing means, jaw means mounted on said extendible end for gripping a tie, rail lifting means mounted on said housing means for lifting a pair of rails above the tie, said rail lifting means having a pair of clamps for engaging respective rails, said clamps respectively being mounted on a pair of spaced supports mounted for coaxial movement along an axis, and hydraulic power means respectively coupled to said extendible end for selectively causing movement of said extendible end, to said jaw means for gripping a tie, and to the rail lifting means for lifting a pair of rails, said hydraulic power means causing said pair of clamps to urge outward into contact between the pair of rails, said hydraulic power means further including a hydraulic cylinder connected to each of said pair of supports.

9. The attachment according to claim 8 further comprising kicker arm means mounted on the housing means for pushing the rail tie.

10. The attachment according to claim 8 wherein said pair of clamps each includes a side surface to engage the bottom of the rail.

11. An attachment for a vehicle having a boom to exchange railroad ties arranged on a support surface comprising housing means having an extendible end being mounted for movement on said housing means, jaw means mounted on said extendible end for gripping a tie, rail lifting means mounted on said housing means for lifting a pair of rails above the tie, hydraulic power means respectively coupled to said extendible end for causing movement of said extendible end, to said jaw means for gripping a tie, and to the rail lifting means for lifting a pair of rails, kicker arm means being pivotally mounted on said housing means for pushing the rail tie, said hydraulic power means being operatively connected to kicker arm means and causing pivotal movement of said kicker arm means for pushing the rail tie being gripped, and said kicker means having a bottom portion, said bottom portion having a roller for contacting the support surface during pivotal movement.

* * * * *